United States Patent [19]

Benaroya

[11] 4,403,577

[45] Sep. 13, 1983

[54] FREE PISTON INTERNAL COMBUSTION ENGINES

[76] Inventor: Henry Benaroya, 41, Boulevard du Commandant Charcot, Neuilly-sur-Seine, France

[21] Appl. No.: 217,993

[22] Filed: Dec. 18, 1980

[30] Foreign Application Priority Data

Jun. 20, 1979 [FR] France ..... 79 15837

[51] Int. Cl.[3] ..... F02B 71/00

[52] U.S. Cl. ..... 123/46 R; 123/51 BD

[58] Field of Search ..... 123/46 R, 46 A, 46 B, 123/51 R, 51 BD

[56] References Cited

U.S. PATENT DOCUMENTS

| | | | |
|---|---|---|---|
| 1,653,373 | 12/1927 | Rice | 123/46 A |
| 2,170,020 | 8/1939 | Gerlach | 123/51 BD |
| 2,980,086 | 4/1961 | Muller | 123/46 A |
| 3,130,716 | 4/1964 | Creswick | 123/46 R |
| 3,320,740 | 5/1967 | Hamkins | 123/46 R |
| 3,347,215 | 10/1967 | Pescara | 123/46 R |
| 3,661,476 | 5/1972 | Benaroya | 123/46 B |

*Primary Examiner*—Craig R. Feinberg

*Attorney, Agent, or Firm*—John T. Synnestvedt; Richard D. Weber

[57] ABSTRACT

A free piston internal combustion engine has at least a motor cylinder formed with intake and exhaust ports and a driving piston reciprocating in said cylinder and cooperating with the exhaust ports. Air delivery means are formed in the cylinder for supplying air originating from a compression cylinder associated with the motor cylinder as a jet directed along the driving piston, towards the head ring of the latter to prevent overheating. The cylinder may additionally be provided with a circuit for circulating a coolant.

7 Claims, 2 Drawing Figures

FREE PISTON INTERNAL COMBUSTION ENGINES

BACKGROUND AND SUMMARY OF THE INVENTION

The invention relates to free piston internal combustion engines of the type comprising driving (or motor) cylinders provided with intake and exhaust ports and locating driving pistons arranged to reciprocate and provided with piston rings cooperating with said ports. The driving pistons are securely connected to compressor pistons located in compressor cylinders and cooperating therewith to deliver air under pressure.

The invention is particularly—although not exclusively—useful in free piston machines constituting gas generators supplying a gas flow at high temperature and pressure to a turbine.

One of the factors which limit the performance of such a machine and its service life between stops for maintenance is the temperature behavior of the components which define the combustion chambers in the motor cylinders.

In particular, the head piston ring of each driving piston (i.e. the ring closest to the combustion chamber) is subjected to very high thermal stresses. At the moment when the head ring initially uncovers the exhaust ports, a jet of burning gas escapes, sweeps the head ring, raises it to a high temperature and carbonises the lubricating oil which protects it against friction.

It may be mentioned that a somewhat similar problem exists in two-stroke Diesel engines, but it is less acute: hot gases tend to overheat the edge of the exhaust ports rather than the head rings. In a Diesel engine, that difficulty may consequently be overcome by circulating a cooling fluid around jackets in which the exhaust ports are formed. Such an approach is not feasible in a free piston engine.

It is an object of the invention to provide a free piston internal combustion engine in which the heating of the head ring of the driving pistons is substantially reduced; it is an other object of the invention is achieve that result without substantial added intricacy.

For that purpose, the invention has taken advantage of the fact that, in free piston engines, air is readily available at a moderate temperature and under a pressure greater than that which exists in the exhaust manifold.

According to the invention, each motor cylinder is provided with air delivery means for supplying air from the compressor cylinders as a jet directed along the driving piston and towards the head ring of the latter at the moment when the piston starts to uncover the exhaust ports.

The air jet at a much lower temperature than that of the exhaust fulfils several functions: it cools the piston rings, particularly the head ring; and it brings lubricating oil to the rings.

In addition, it has appeared that, although the pressure in the air jet is well below that which exists in the driving cylinder at the moment when the ports are uncovered, the air jet deflects the burning gas jet erupting from the driving cylinder away from the rings.

Each air delivery means associated with a driving piston cooperating with exhaust ports comprises at least one delivery passage or channel per exhaust port. All channels can be supplied with air from a same annular chamber, connected to a tank storing scavenging air for the engine.

It may be noted that the approach is not suitable for use in a Diesel engine where air available after pressurization in the engine crankcase is under a pressure too low for exhaust gas deflection. The invention requires availability of air under an adequate pressure and preferably slightly loaded with lubricant.

The cylinder wall is also subjected to considerable heat stresses, particularly in the head portion thereof, where it is continuously uncovered by the driving piston. That wall typically comprises a jacket force fit into an annular part bearing the fuel injection valve. The cylinder may preferably be provided with a cooling circuit comprising a circular channel provided between a ring of the cylinder and the jacket. That channel communicates longitudinal inlet channels for cooling liquid and return channels interleaved with the inlet channels.

Each driving cylinder is typically provided with two reciprocating pistons whose movements toward and away from each other are synchronised. Then the wall of the cylinder will generally include a central ring in which two jackets are fitted, one of which is provided with exhaust ports and the other with intake ports. The cooling circuit of the cylinder wall may then include axially directed inlet grooves for cooling fluid, formed along that jacket which is provided with exhaust ports; the circuit may further include the circular channel formed in the jacket, fluid return grooves and outlet holes communicating fluid from the return grooves to a space formed around the central ring. A similar channel and groove system is associated symmetrically with the jacket provided with intake ports.

The invention will be better understood from the following description of a particular embodiment thereof given by way of example.

SHORT DESCRIPTION OF THE DRAWINGS

DETAILED DESCRIPTION OF AN EMBODIMENT

Figure 1:
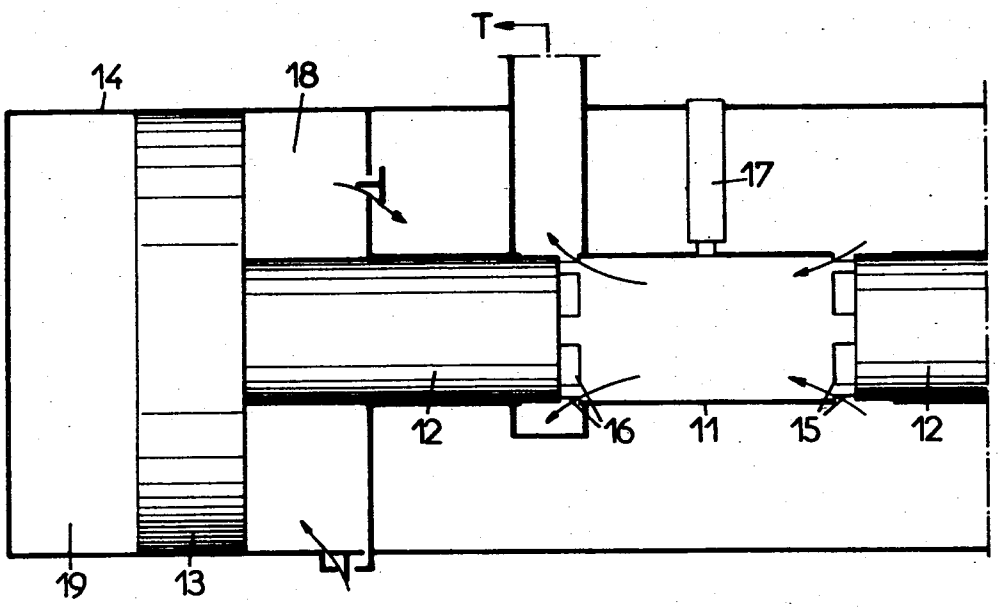
FIG. 1 is a schematic view of a portion of a free piston engine, in cross-section along a plane passing through the driving cylinder axis.

Referring to FIG. 1, there is shown a free piston engine having a driving cylinder 11 locating two driving pistons 12 each forming part of a free piston assembly which includes, in addition to piston 12, a compressor piston 13 moving in a compression cylinder 14. The two free pistons are connected together by a mechanical synchronising device 44 of any appropriate type whereby closing and spreading movements of the pistons occur in synchronism. The wall of the driving cylinder 11 is formed with intake ports 15 for delivering combustion and scavenging air to the driving cylinder 11. The wall is also formed with a plurality of exhaust ports 16. All ports of the same type are distributed at equal angular intervals around the axis of the wall. In the transverse mid-plane of the driving cylinder 11, there is arranged at least one fuel injection valve 17 for delivery of fuel into the driving cylinder 11 while the pistons 12 are close to their inner dead center.

The compressor piston 13 of each free piston assembly divides the associated cylinder 14 into two compartments 18 and 19. The inner compartment 18 constitutes a compression cylinder provided with intake and discharge valves. The compartment 19 may constitute a pneumatic accumulator for returning the free piston or may constitute an additional compression cylinder; in the latter case, it must also be provided with valves.

Several units each comprising two free piston assemblies 13 may be associated in a tandem arrangement or, better still, a multi-tandem arrangement, as described for instance in U.S. Pat. No. 3,669,571 of the present Applicant.

Figure 2:
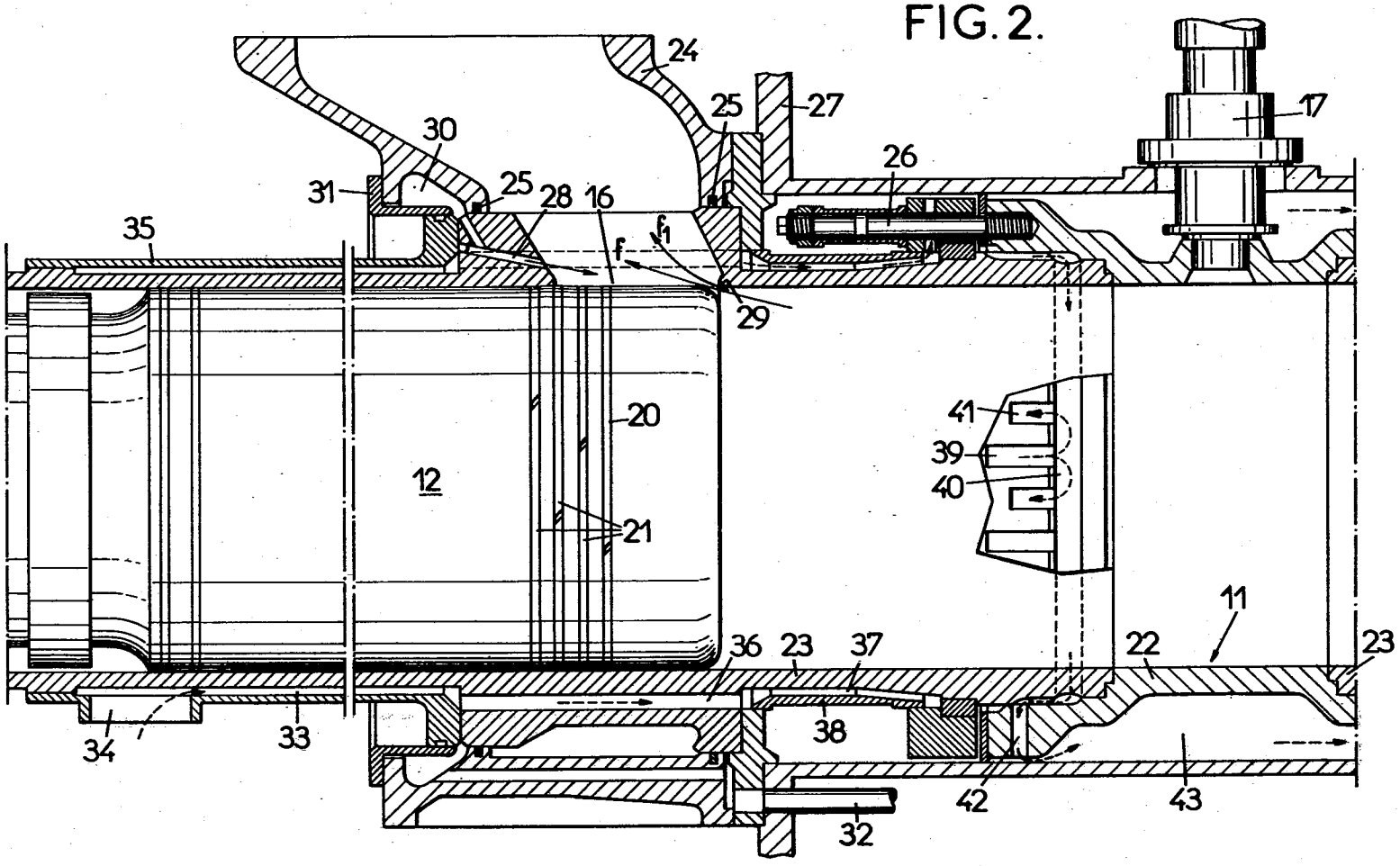
FIG. 2 is a schematic view on an enlarged scale showing the cooling means of the head rings and of the jackets, according to a particular embodiment of the invention.

Referring now to FIG. 2, where part only of the driving cylinder 11 and the driving piston 12 which cooperates with the exhaust ports 16 are shown, it is seen that the piston 12 includes a head ring 20 followed by three additional rings 21 which will be designated as rear rings.

The wall of the cylinder 11 in which the driving pistons 12 reciprocate comprises a central ring 22 in which are force-fit two jackets 23 secured to the central ring 22 by means comprising threaded pins 26. That jacket 23 in which the exhaust ports 16 are formed is removably secured to an exhaust manifold 24 by a plurality of fasteners (not shown). Circumferential seals 25 are provided where necessary for fluid tightness. Structural integrity is achieved by a frame 27 in several sections held together by suitable fasteners.

As already indicated, piston 12 progressively clears the exhaust ports 16 when on its power stroke, i.e. when moving away from its inner dead center. When the piston reaches the position in which it is shown in FIG. 2, a jet of exhaust gas at high temperature under pressure (typically at a temperature of from 700° to 800° C. under a pressure of 14 bars) tends to erupt in the direction indicated by arrow f.

The action of the hot gas jet is countered by introducing air at a lower temperature through delivery means. In the illustrated embodiment, the delivery means includes, for each port 16, a passage 28 which is formed in an enlarged section of the jacket 23 and opens into the rear part of the exhaust port 16 (that is to say opposite the edge 29 which is first cleared by the piston. The passage may preferably be directed towards that rear edge. All passages 28 are supplied by a same annular distributing chamber 30 and defined by the manifold 24 and a flange 31. That chamber is connected to receive air from the scavenging tank, supplied by a compressor cylinder 18, through a line 32. The channels 28 will typically be at a relatively small angle to the axis of the cylinders, for example between 10° and 20°.

In an engine which delivers the exhaust gases at a pressure of 14 bars during the initial exhaust phase, the following values may be representative of the conditions: the pressure and the temperature in the exhaust manifold are respectively of about 6 bars and 500° C. The scavenging air charged with oil is at a pressure of about 6.5 bars and at a temperature of about 210° C. Although the air pressure is only slightly greater than that of the pressure in the exhaust manifold and is considerably less than that of the exhaust gases during the initial phase of the exhaust, the air jet deflects the hot gases, whose direction is changed from that indicated by arrow f to that represented by arrow $f_1$. The deflection has a further action in protecting the head ring 20.

As shown in FIG. 2, the cylinder includes a jacket cooling circuit which avoids overheating of the jackets and particularly of the portion thereof close to the central ring section. This circuit includes, starting from the outside to the midplane of the cylinder, an annular circumferential passage 33 supplied with cooling water through a connector 34 and defined by the outside surface of the rear portion of the jacket 23, a sleeve 35 which is connected thereto, and the rear surface of an enlarged portion of jacket 23. Axial holes 36 formed in the enlarged portion of the jacket communicate passage 33 with a second annular space 37 formed between the jacket and the ring 38 which is secured thereto. The cooling water flows out of the second annular space, sweeps the tie-bolts 26 in passage and enters inlet channels 39, constituted by grooves cut out in the outer wall of the jacket 23. The inlet channels 39 are connected by a circular circulating channel 40 cut out in immediate proximity to the terminal portion of the jacket to return channels 41. Channels 41 are shorter than the channels 39 and interleaved with them. They circulate the cooling water back via discharge holes 42 to a space 43 formed between the central ring section 22 and the frame 27. From the space 43 the cooling water flows to a discharge connector along a path symmetrical with that which it has followed along the jacket 23. The path of the cooling water, which may be replaced with another coolant, is indicated by dashed arrows in FIG. 2.

I claim:

1. In a free piston internal combustion engine, a motor cylinder having a wall formed with axially spaced intake and exhaust ports, at least one driving piston located in said cylinder for reciprocating movement and drivably connected to a compressor piston located in a compression cylinder, a head ring carried by said driving piston and cooperating with at least said exhaust ports to progressively uncover said exhaust ports during each power stroke of said driving piston;

and air delivery means, separate from said intake ports, formed in said cylinder adjacent said exhaust ports and spaced from said intake ports for supplying air originating from said compression cylinder toward the motor cylinder as a jet directed along those portions of said driving piston and at said head ring which cooperate with said exhaust ports during the moment when said driving piston initially clears the exhaust ports.

2. A free piston engine according to claim 1, wherein said motor cylinder is provided with a cooling circuit, said circuit comprising a circular channel formed in the cylinder wall and communicating with axially directed cooling liquid inlet channels with return channels interleaved with the inlet channels in the circumferential direction around the cylinder axis.

3. A free piston engine according to claim 1, wherein said air delivery means comprises at least one delivery passage per exhaust port, all passages associated with said driving piston being supplied with air from an annular chamber which is connected to a tank storing scavenging air received from said compression cylinder.

4. A free piston engine according to claim 3, wherein each said exhaust port has an edge which is first cleared by said driving piston during the power stroke thereof and the delivery passage associated with said ports is located to direct said jet toward said edge.

5. A free piston engine according to claim 3 or 4, wherein each said passage is at an angle of from 10° to 20° with the axis of the motor cylinder.

6. In a free piston internal combustion engine having at least one motor cylinder, a pair of driving pistons received in said cylinder for reciprocable movement and a synchronizing linkage for time related movement of said pistons, said motor cylinders comprising a central ring section and two axially spaced jackets connected to said ring section, one jacket is formed with exhaust ports cooperating with one of said pistons and the other jacket is formed with intake ports cooperating with the other one of said pistons, air delivery means provided in said one jacket which is formed with exhaust ports for supplying air under pressure into the motor cylinder as a jet directed along the associated driving piston and towards a head ring of said one of said driving pistons during the moment when the latter mentional piston initially clears the exhaust ports.

7. A free piston internal combustion engine according to claim 6, further comprising a cooling circuit for said jackets, comprising axially directed inlet grooves for a cooling fluid formed along at least that jacket which is provided with exhaust ports, axially directed return grooves for said cooling fluid interleaved with said inlet grooves in the circumferential direction, and a circumferential channel formed in said jacket and communicating said inlet grooves and return grooves.

* * * * *